US007584830B2

(12) United States Patent
Smith

(10) Patent No.: US 7,584,830 B2
(45) Date of Patent: Sep. 8, 2009

(54) SUITCASE AND DESK COMBINATION DEVICE

(76) Inventor: Jeremy A. Smith, 4824 Yoest Dr., Westerville, OH (US) 43081

( * ) Notice: Subject to any disclaimer, the term of this patent is extended or adjusted under 35 U.S.C. 154(b) by 663 days.

(21) Appl. No.: 11/177,661

(22) Filed: Jul. 11, 2005

(65) Prior Publication Data

US 2007/0007094 A1 Jan. 11, 2007

(51) Int. Cl.
*A45F 3/00* (2006.01)

(52) U.S. Cl. ..... 190/11; 190/18 A; 190/12 A

(58) Field of Classification Search ..... 190/11, 190/12 A, 12 R, 18 A, 903, 111
See application file for complete search history.

(56) References Cited

U.S. PATENT DOCUMENTS

| | | | | | |
|---|---|---|---|---|---|
| 571,124 | A | * | 11/1896 | Hurd | 190/111 |
| 873,855 | A | * | 12/1907 | Goldin | 190/11 |
| 1,368,452 | A | | 2/1921 | Puff | |
| 2,473,022 | A | | 6/1949 | Fenske, Jr. | |
| 3,474,833 | A | * | 10/1969 | Garrette, Jr. et al. | 138/120 |
| 4,083,089 | A | * | 4/1978 | Minami | 24/381 |
| D273,537 | S | | 4/1984 | Gerch | |
| 4,790,416 | A | | 12/1988 | Baker | |
| 4,919,498 | A | | 4/1990 | Turner | |
| 5,111,919 | A | * | 5/1992 | Hamatani et al. | 190/109 |
| 5,116,289 | A | * | 5/1992 | Pond et al. | 190/18 A |
| 5,660,117 | A | | 8/1997 | Noble | |
| 6,041,723 | A | | 3/2000 | Peterson | |
| 6,041,900 | A | * | 3/2000 | Sadow et al. | 190/18 A |
| 6,345,709 | B1 | * | 2/2002 | Cheng | 190/119 |
| 6,637,350 | B2 | * | 10/2003 | McKsymick | 108/25 |
| 2002/0063072 | A1 | * | 5/2002 | Pham | 206/320 |
| 2004/0226791 | A1 | * | 11/2004 | Levy | 190/11 |

* cited by examiner

*Primary Examiner*—Tri M Mai

(57) ABSTRACT

A suitcase and desk combination device includes a housing that has a bottom wall, a top wall and a peripheral wall that is attached to and extends between the top and bottom walls. The peripheral wall has a break therein and that defines an opening for accessing an interior of the housing. The bottom wall has a bottom edge, a top edge, a first lateral edge and a second lateral edge. The bottom wall is substantially planar. Each of a plurality of legs extends into the top wall. Each of the legs has a free end and each of the legs is selectively telescoping so that the free ends may be selectively positionable in a stored position adjacent to the top wall or in an extended position extending away from the top wall.

11 Claims, 8 Drawing Sheets

SUITCASE AND DESK COMBINATION DEVICE

BACKGROUND OF THE INVENTION

1. Field of the Invention

The present invention relates to suitcase devices and more particularly pertains to a new suitcase device for which includes extendable legs for allowing the suitcase to be used as a work surface or desk.

2. Description of the Prior Art

The use of collapsible work area devices is known in the prior art. U.S. Pat. No. 4,919,498 describes a collapsible desk assembly which may be folded up into a carrying case. Another type of collapsible work area device is found in U.S. Pat. No. 5,660,117 and include a paper support area which had a plurality of telescoping legs attached thereto. Another such device is found in U.S. Pat. No. 2,473,022 and includes combined carrying case and a table.

While these devices fulfill their respective, particular objectives and requirements, the need remains for a device that includes a generally conventional suitcase which may be used as a desk by extending legs outwardly of the suitcase. This will allow a traveler to use the suitcase as a desk while waiting at an airport or during other times when work space is needed.

SUMMARY OF THE INVENTION

The present invention meets the needs presented above by generally comprising a housing that has a bottom wall, a top wall and a peripheral wall that is attached to and extends between the top and bottom walls. The peripheral wall has a break therein and that defines an opening for accessing an interior of the housing. The bottom wall has a bottom edge, a top edge, a first lateral edge and a second lateral edge. The bottom wall is substantially planar. Each of a plurality of legs extends into the top wall. Each of the legs has a free end and each of the legs is selectively telescoping so that the free ends may be selectively positionable in a stored position adjacent to the top wall or in an extended position extending away from the top wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
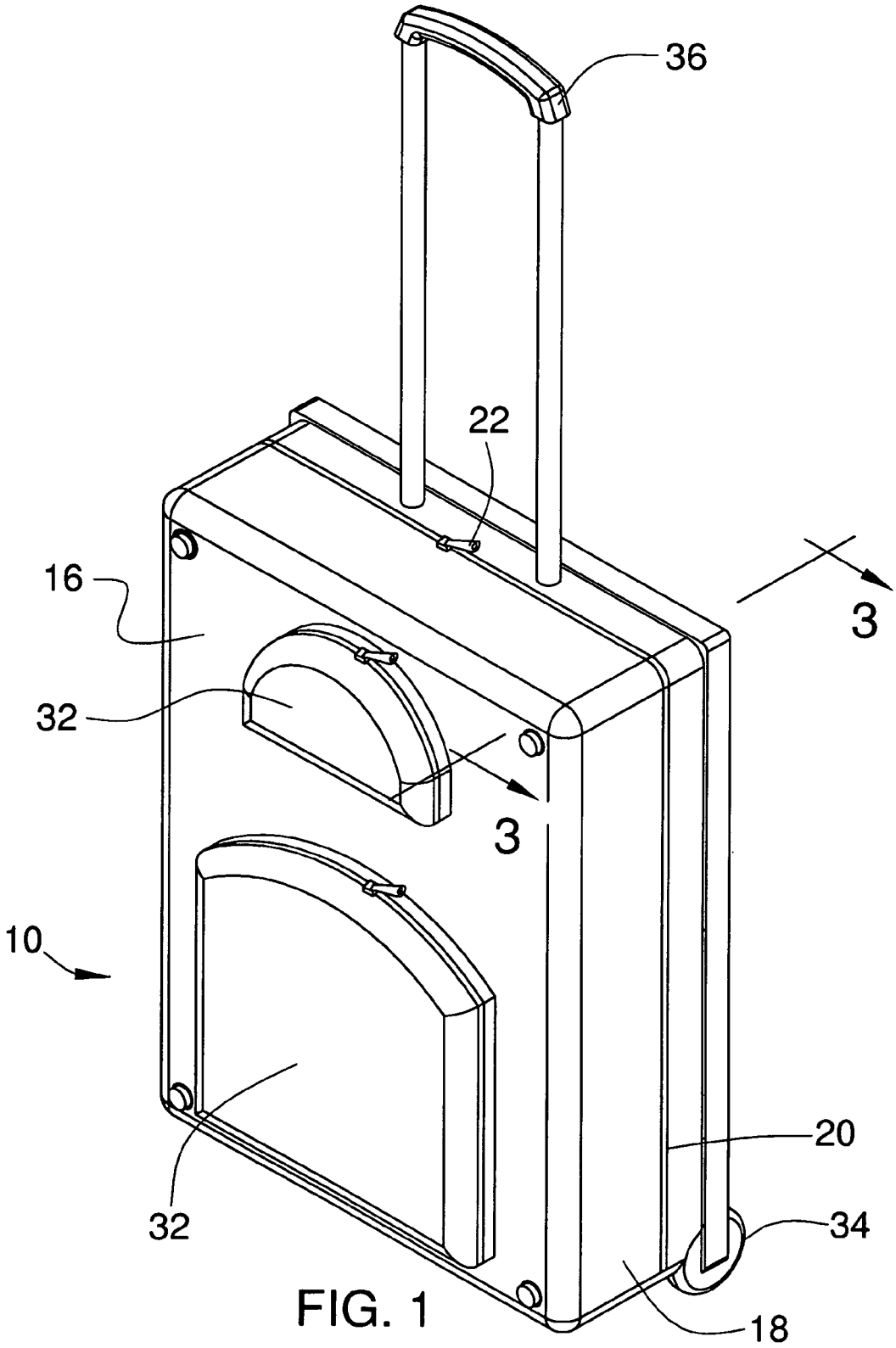
FIG. 1 is a perspective view of a suitcase and desk combination device according to the present invention.

With reference now to the drawings, and in particular to FIGS. 1 through 13 thereof, a new suitcase device embodying the principles and concepts of the present invention and generally designated by the reference numeral 10 will be described.

As best illustrated in FIGS. 1 through 13, the suitcase and desk combination device 10 generally comprises a housing 12 that has a bottom wall 14, a top wall 16 and a peripheral wall 18 that is attached to and extends between the top 16 and bottom 14 walls. The peripheral wall 18 has a break 20 therein that defines an opening for accessing an interior of the housing 12. A zipper 22 is attached to the peripheral wall 18 and extends along the break 20 for selectively closing the opening. The bottom wall 14 has a bottom edge 24, a top edge 26, a first lateral edge 28 and a second lateral edge 30. The break 20 is elongated and is positioned nearer to the bottom wall 14 than the top wall 16. The bottom wall 14 is substantially planar. A plurality of pockets 32 is attached to the top wall 16.

A pair of wheels 34 is rotatably coupled to the housing 12 and is positioned at a juncture of the bottom edge 24 and the peripheral wall 18. A retractable handle 36 is attached to the housing 12. The retractable handle 36 is attached to the peripheral wall 18 and is positioned adjacent to the upper edge 26 of the bottom wall 14. The handle 36 is selectively extendable inwardly or outwardly from the housing 12.

Figure 2:
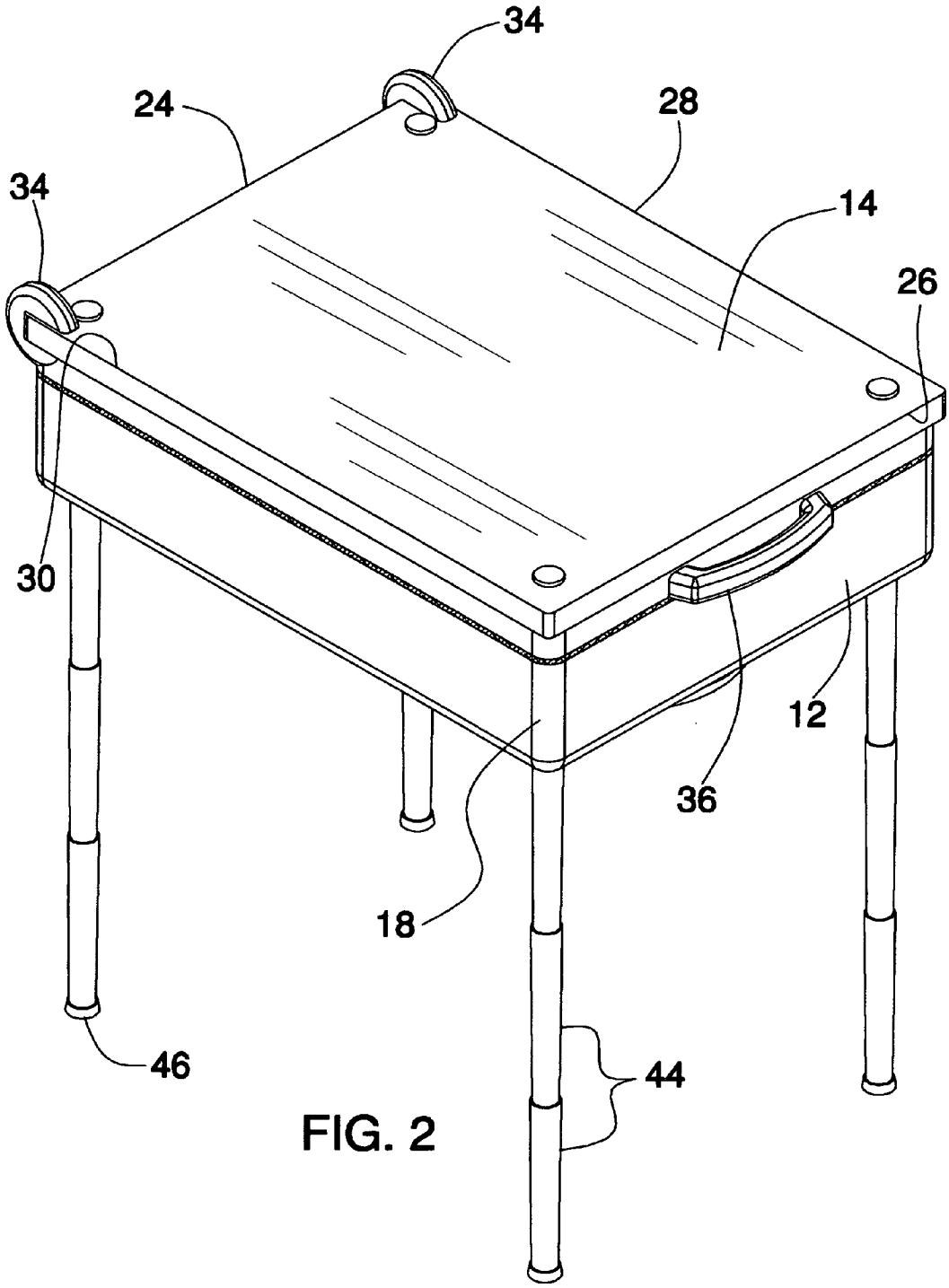
FIG. 2 is a bottom perspective view of the present invention.
Figure 3:
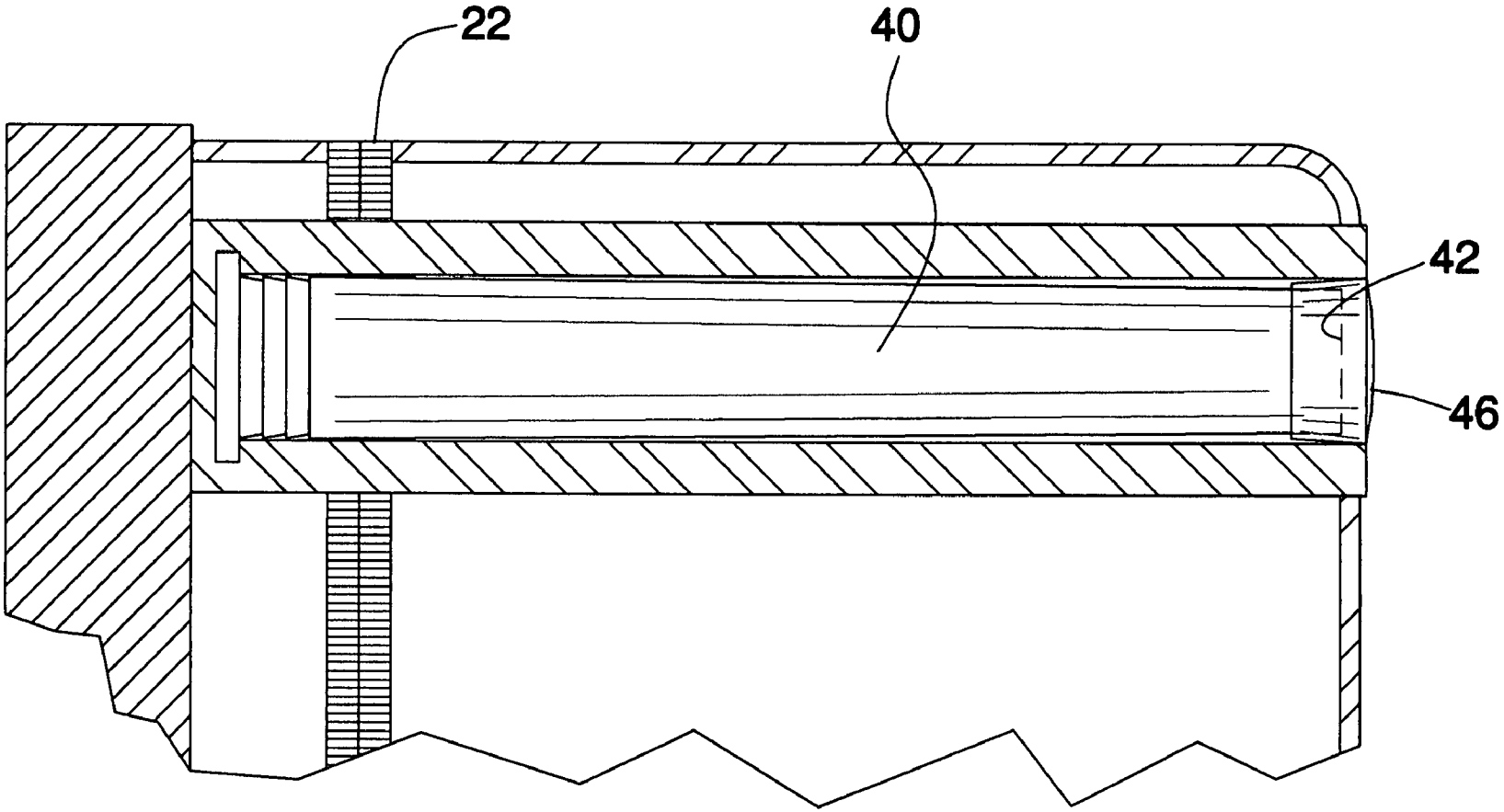
FIG. 3 is a cross-sectional view taken along line 3-3 of FIG. 1 of the present invention.
Figure 4:
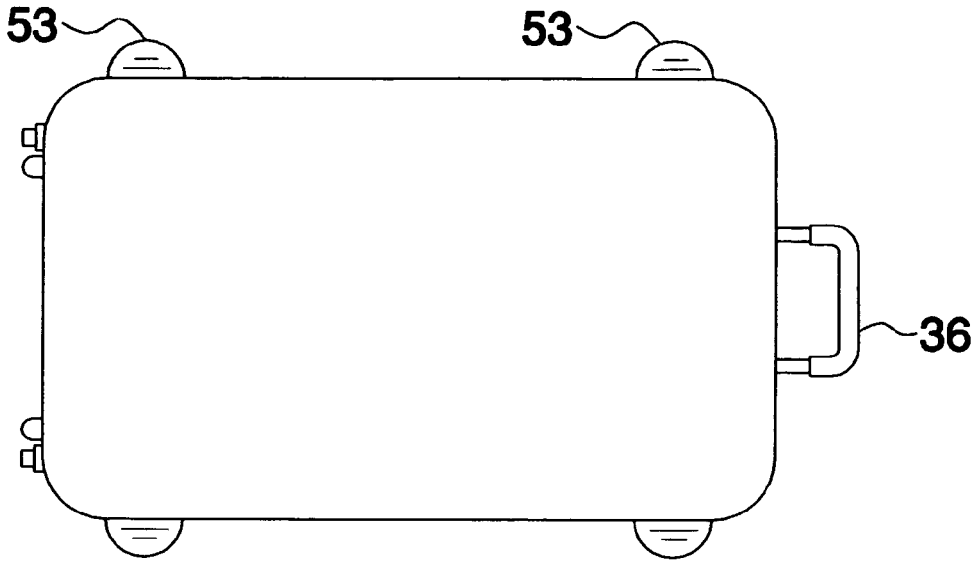
FIG. 4 is a bottom view of a second embodiment of the present invention.
Figure 5:
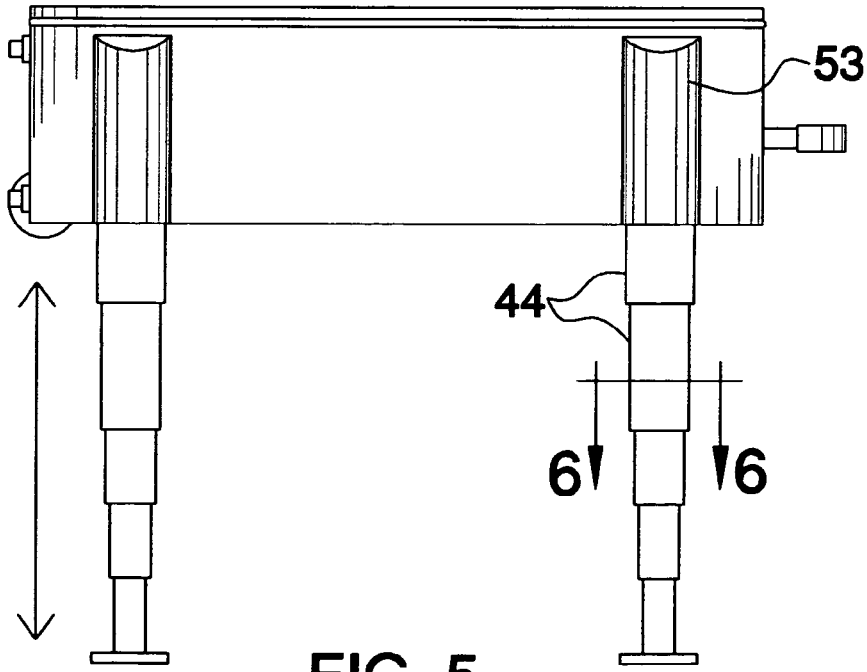
FIG. 5 is a side view of the second embodiment of the present invention.

Each of a plurality of legs 40 extends into the top wall 16. Each of the legs 40 has a free end 42 and each of the legs 40 is selectively telescoping. The free ends 42 may be selectively positionable in a stored position adjacent to the top wall 16 or in an extended position extending away from the top wall 16. As shown in FIG. 2, the legs 40 include a plurality of sections 44 frictionally engaged with each other when the legs 40 are in the extended position. Each of the sections 44 has a first end 51 and a second end 52. Each of the first ends 51 of the sections 44 is positioned adjacent to the second ends 52 of adjacent ones of the sections 44 when the sections 44 are in the extended position. FIG. 5 shows a second embodiment where the edges of the top wall 16 extend outwardly from the housing 12 in order to hold the legs 40 in compartments 53 at the sides of the housing 12. This allows for additional space within the housing 12.

A plurality of foot members 46 is provided. Each of the foot members 46 is attached to one of the free ends 42 and each of the foot members 46 comprises a resiliently elastic material. The plurality of legs 40 preferably includes 4 legs each positioned adjacent to one of corners of the top wall 16.

Figure 6A:
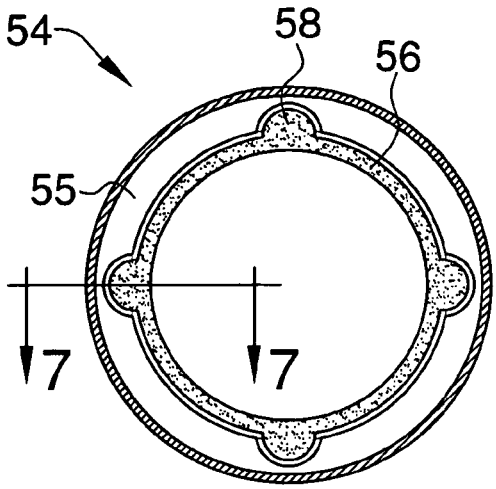
FIG. 6*a* is a top cross-sectional view of first position of a locking assembly of present invention.
Figure 6B:
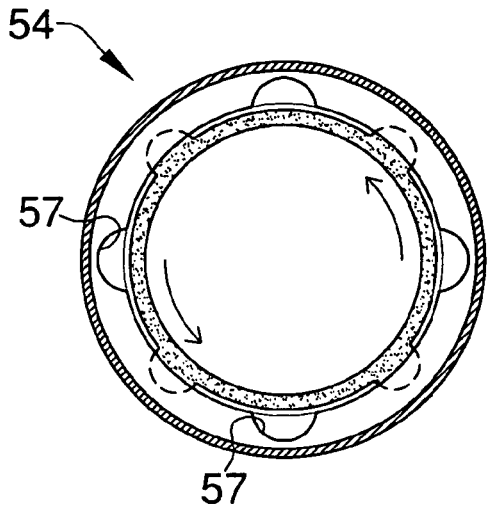
FIG. 6*b* is a top cross-sectional view of as second position of the locking assembly of the present invention.
Figure 7:
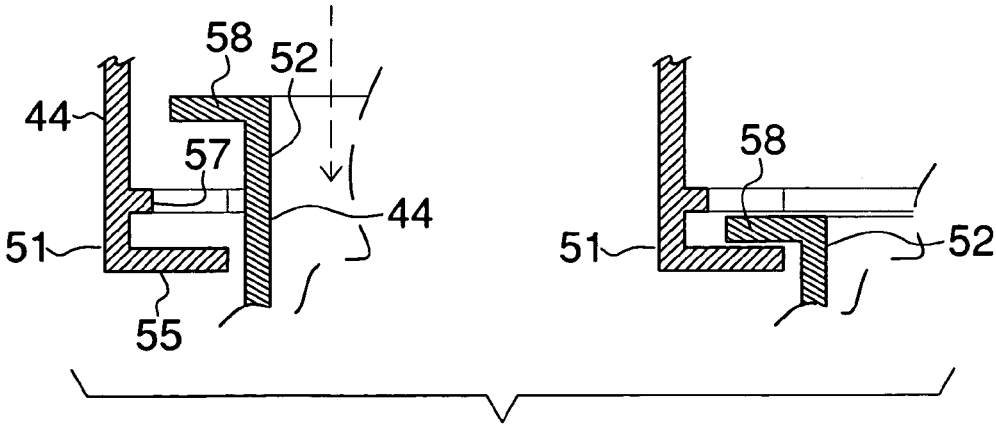
FIG. 7 is a side cross-sectional view of the locking assembly of the present invention.
Figure 8:
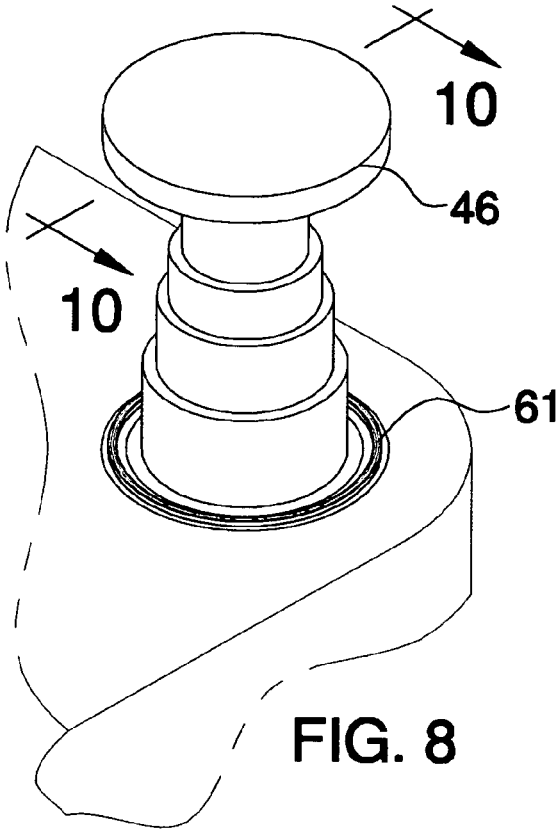
FIG. 8 is a bottom perspective view of a retaining member of the present invention.
Figure 9:
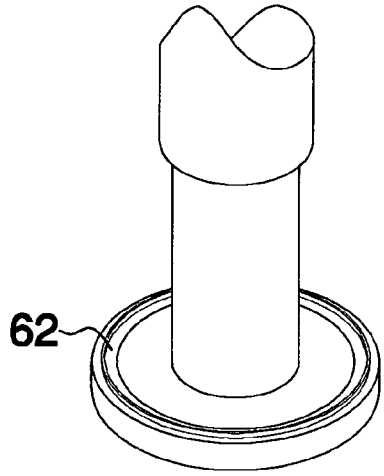
FIG. 9 is a top perspective view of the retaining member of the present invention.
Figure 10:
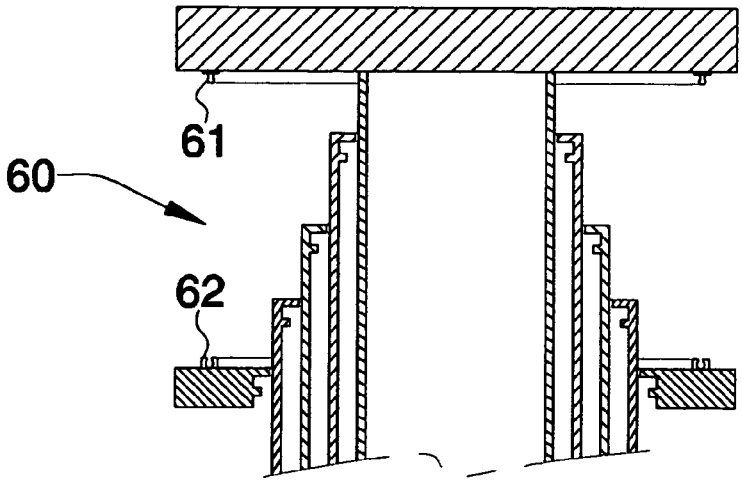
FIG. 10 is a cross-sectional view of the retaining member of the present invention.

A plurality of locking members 54 selectively locks each of the legs 44 in the extended position in the second embodiment as shown in FIG. 6*a*, 6*b* and 7. Each of the locking members 54 includes a first mating member 55 and a second mating member 56. The first mating members 55 are attached to one of the first ends 51 of the sections 44 and each of the second mating members 56 is attached to one of the second ends 52 of the sections 44. The first 55 and second 56 mating members are releasably securable to each other. The first mating member 55 includes a pair of spaced discs wherein one of the discs has a plurality of notches 57 extending therethrough. The second mating member 56 includes a plurality of tabs 58 extendable through notches 57. The second mating member 56 is then rotated with respect to the first mating member 55 to retain the tabs 58 between the two discs.

A plurality of retention members 60 selectively retains each of the legs 44 in a stored position. Each of the retention members 60 includes an annular ridge 61 positioned on a top side of each of the foot members 46 and an annular depression 62 in the housing 12 extending around each of the legs 44. Each of the ridges 61 is aligned with one of the depressions 62 so that each of the ridges 61 is extendable into one of the depressions 62 when the legs 44 are in the stored position. Each of the ridges 61 is frictionally couplable with one of the depressions 62.

Figure 11:
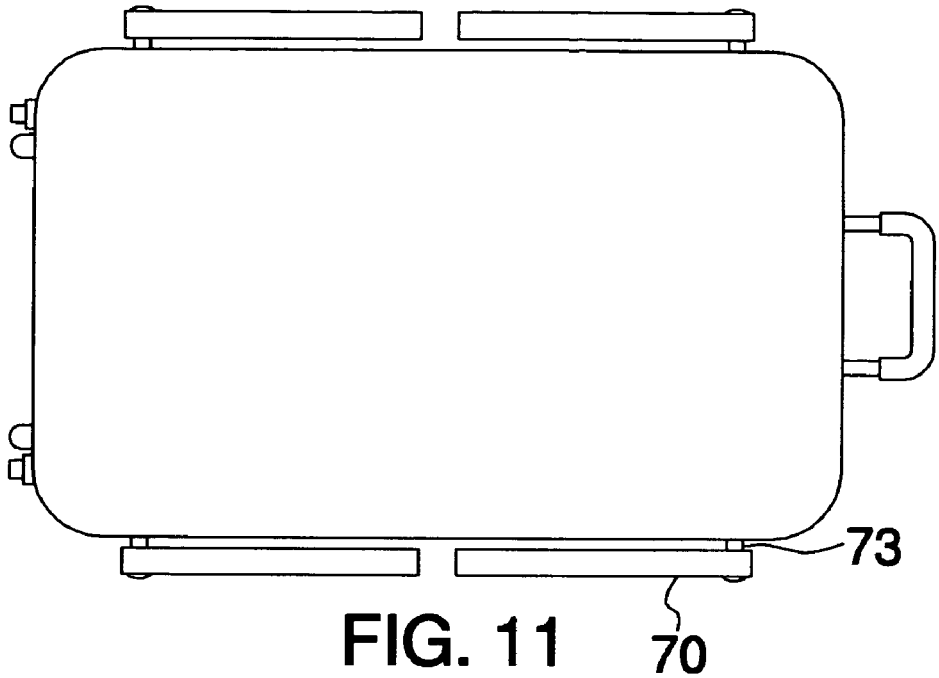
FIG. 11 is a bottom view of a third embodiment of the present invention.
Figure 12:
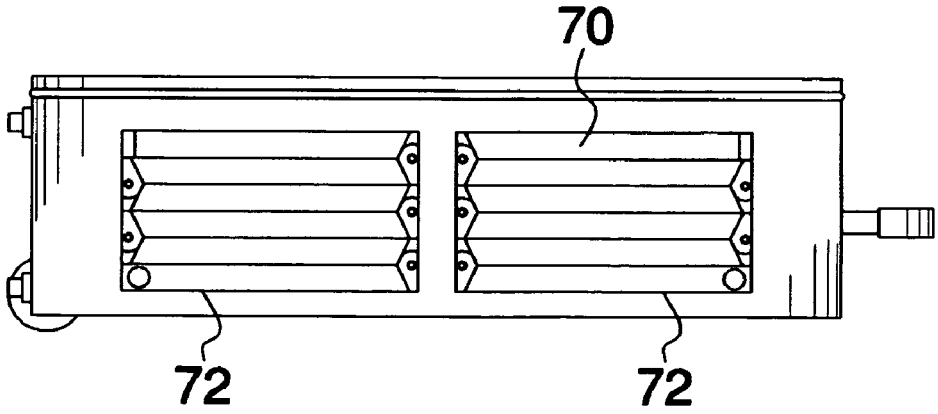
FIG. 12 is a side view of the third embodiment of the present invention.
Figure 13:
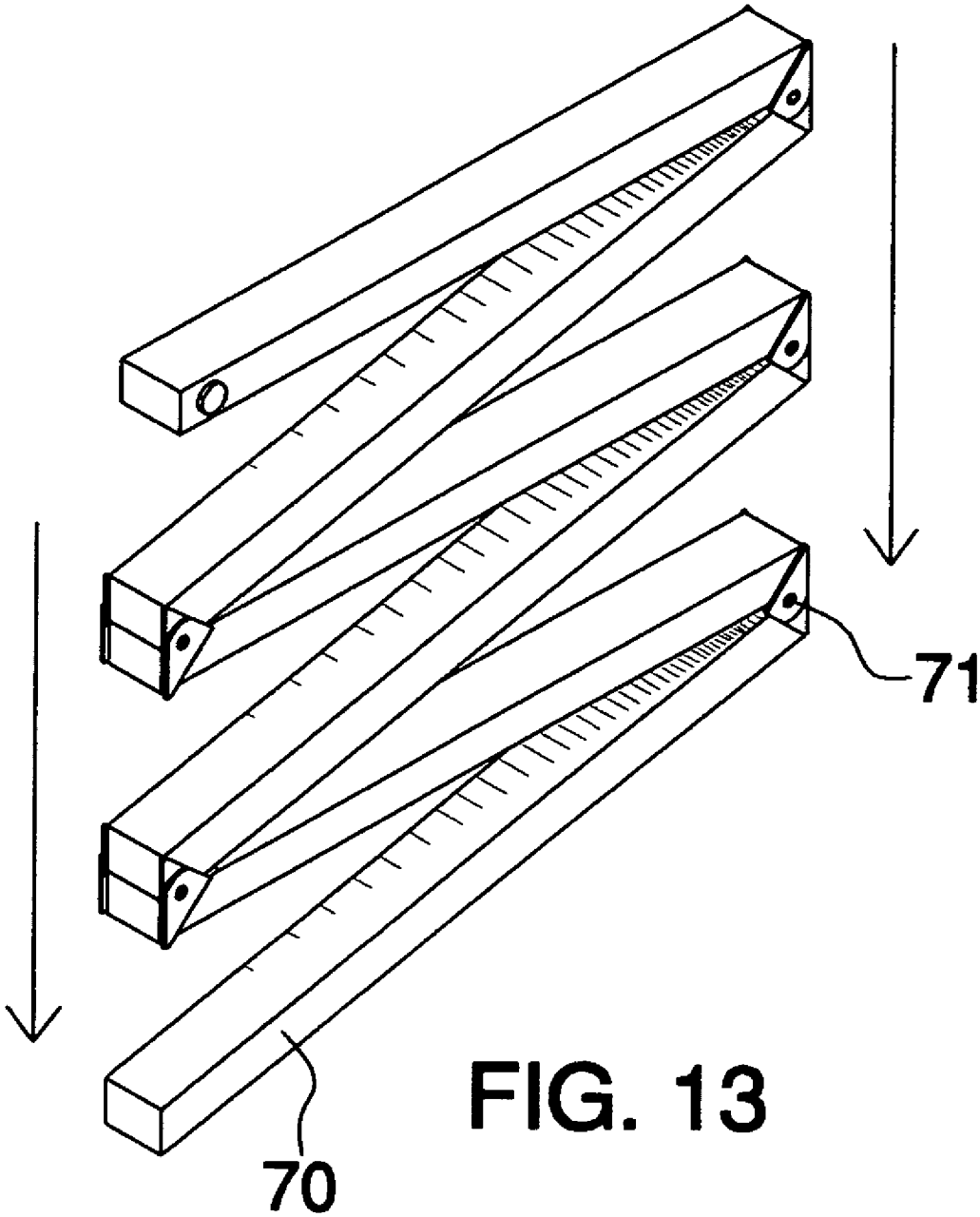
FIG. 13 is a perspective view of a foldable leg of the third embodiment of the present invention.

FIGS. 11-13 depict a third embodiment including foldable legs 70 are positionable in slots 72 in the peripheral wall 18. The foldable legs 70 include a plurality of joints 71 allowing them to be positioned in an extended position or in a folded position. The foldable legs 70 are attached by a pivot rod 73 to allow them to selectively rotated with respect to the housing 12. The pivot rod 73 is extendable into the housing to allow the foldable legs 70 to be returned to the slots 72.

In use, device 10 is used as a conventional suitcase. When a work area is provided, the legs 40 are extended outwardly of the top wall 16 and positioned as shown in FIG. 2 so that the bottom wall 14 may be used as a desk. The bottom wall 14 is preferably comprised of substantially rigid material. The break 20 is positioned adjacent to the bottom wall 14, unlike a conventional suitcase which places the break adjacent to the top wall, so that a user of the device 10 can open the housing 12 without spilling its contents.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suitcase assembly including:

a housing having a bottom wall, a top wall and a peripheral wall being attached to and extending between said top and bottom walls, said peripheral wail having a break therein and defining an opening for accessing an interior of said housing, said bottom wall having a bottom edge, a top edge, a first lateral edge and a second lateral edge, said bottom wall being substantially planar; and a plurality of legs extending into said top wall, each of said legs having a free end, each of said legs being selectively telescoping such that said free ends may be selectively positionable in a stored position adjacent to said top wall or in an extended position extending away from said top wall;

a plurality of foot members, each of said foot members being attached to one of said free ends; and a plurality of retention members for selectively retaining each of said legs in a stored position, each of said retention members including an annular ridge positioned on a top side of each of said foot members and an annular depression in said housing extending around each of said legs, each of said ridges being aligned with one of said depressions such that each of said ridges are extendable into one of said depressions when said legs are in said stored position, each of said ridges being frictionally couplable with one of said depressions.

2. The assembly according to claim 1, further including a zipper being attached to said peripheral wall and extending along said break for selectively closing said opening, said break being positioned nearer to said bottom wall than said top wall.

3. The assembly according to claim 2, further including a pair of wheels being rotatably coupled to said housing and being positioned at a juncture of said bottom edge and said peripheral wall.

4. The assembly according to claim 2, further including a retractable handle being attached to said housing, said retractable handle being attached to said peripheral wall and being positioned adjacent to said upper edge of said bottom wall.

5. The assembly according to claim 2, further including a plurality of foot members, each of said foot members being attached to one of said free ends, each of said foot members comprising a resiliently elastic material.

6. The assembly according to claim 2, further including a plurality of pockets being attached to said top wall.

7. The assembly according to claim 2, further including:

each of said legs including a plurality of sections, each of said sections having a first end and a second end, each of said first ends of said sections being positioned adjacent to said second ends of adjacent ones of said sections when said sections are in said extended position; and a plurality of locking members for selectively locking each of said legs in said extended position.

8. The assembly according to claim 7, wherein each of said locking members includes a first mating member and a second mating member, each of said first mating members being attached to one of said fist ends of said sections and each of said second mating members being attached to one of said second ends of said sections, said first and second mating members being releasably securable to each other.

9. The assembly according to claim 1, further including:

each of said legs including a plurality of sections, each of said sections having a first end and a second end, each of said first ends of said sections being positioned adjacent to said second ends of adjacent ones of said sections when said sections are in said extended position; and a plurality of locking members for selectively locking each of said legs in said extended position.

10. The assembly according to claim 9, wherein each of said locking members includes a first mating member and a second mating member, each of said first mating members being attached to one of said first ends of said sections and each of said second mating members being attached to one of said second ends of said sections, said first and second mating members being releasably securable to each other.

11. A suitcase assembly including:

a housing having a bottom wall, a top wall and a peripheral wall being attached to and extending between said top and bottom walls, said peripheral wall having a break therein and defining an opening for accessing an interior of said housing, a zipper being attached to said peripheral wall and extending along said break for selectively closing said opening, said bottom wall having a bottom edge; a top edge, a first lateral edge and a second lateral edge, said break being elongated, said break being positioned nearer to said bottom wall than said top wall, said bottom wall being substantially planar;

a pair of wheels being rotatably coupled to said housing and being positioned at a juncture of said bottom edge and said peripheral wall;

a retractable handle being attached to said housing, said retractable handle being attached to said peripheral wall and being positioned adjacent to said upper edge of said bottom wall, said handle being removably extendable inwardly or outwardly from said housing;

a plurality of legs extending into said top wall, each of said legs having a free end, each of said legs being selectively telescoping and including a plurality of sections such that said free ends may be selectively positionable in a stored position adjacent to said top wall or in an extended position extending away from said top wall, each of said sections having a first end and a second end, each of said first ends of said sections being positioned adjacent to said second ends of adjacent ones of said sections when said sections are in said extended position;

a plurality of locking members for selectively locking each of said legs in said extended position, each of said locking members including a first mating member and a second mating member, each of said first mating members being attached to one of said first ends of said sections and each of said second mating members being attached to one of said second ends of said sections, said first and second mating members being releasably securable to each other;

a plurality of foot members, each of said foot members being attached to one of said free ends, each of said foot members comprising a resiliently elastic material;

a plurality of retention members for selectively retaining each of said legs in a stored position, each of said retention members including an annular ridge positioned on a top side of each of said foot members and an annular depression in said housing extending around each of said legs, each of said ridges being aligned with one of said depressions such that each of said ridges are extendable into one of said depressions when said legs are in said stored position, each of said ridges being frictionally couplable with one of said depressions; and a plurality of pockets being attached to said top wall.

* * * * *